United States Patent [19]

Ehrle

[11] Patent Number: 4,960,226

[45] Date of Patent: Oct. 2, 1990

[54] APPARATUS FOR DISPENSING PENCILS WITH ERASURE FERRULES HAVING A HOPPER WITH A COATING ON ITS SURFACE THAT PREVENTS THE FERRULES FROM CONTACTING THE HOPPER

[76] Inventor: Sylvester L. Ehrle, 1103 Eton, Richardson, Tex. 75080

[21] Appl. No.: 362,062

[22] Filed: Jun. 6, 1989

[51] Int. Cl.[5] ..... B65H 3/62

[52] U.S. Cl. ..... 221/202; 221/205; 221/264; 221/312 R

[58] Field of Search ..... 221/202, 205, 264, 312 R

[56] References Cited

U.S. PATENT DOCUMENTS

| | | | |
|---|---|---|---|
| 439,030 | 10/1890 | Dieterich . | |
| 1,682,629 | 8/1928 | Rossi . | |
| 1,814,955 | 7/1931 | Oddsen | 221/264 X |
| 1,843,233 | 2/1932 | Kaiser . | |
| 2,076,299 | 4/1937 | Kloess | 194/48 |
| 2,655,418 | 10/1953 | Oerding | 312/75 |
| 2,732,974 | 1/1956 | Hedges | 221/202 X |
| 3,175,669 | 3/1965 | Garvin | 221/202 X |
| 3,743,135 | 7/1973 | Brumley | 221/205 |
| 4,405,060 | 9/1983 | Hsei | 221/264 X |
| 4,457,451 | 7/1984 | Ichikawa | 221/190 |
| 4,588,108 | 5/1986 | Knez et al. | 221/68 |
| 4,706,842 | 11/1987 | Guadagino | 221/14 |

*Primary Examiner*—Andres Kashnikow
*Assistant Examiner*—Kenneth DeRosa
*Attorney, Agent, or Firm*—Richards, Medlock & Andrews

[57] ABSTRACT

Disclosed is apparatus for dispensing cylindrical objects such as pencils. The objects are stored in a hopper within a housing and fall out of the hopper into a delivery reservoir which is movable between a first position and a second position. When an activation mechanism moves the reservoir to the second position, the objects in the reservoir fall to an outlet in the housing. As the reservoir moves to its second position, an agitator aligns the pencils in the hopper to avoid bridging. A platform over the hopper holds some of the objects off the objects in the hopper. A patina on the agitator holds the high friction parts of the objects off the agitator so the objects roll or slide more easily.

5 Claims, 4 Drawing Sheets

APPARATUS FOR DISPENSING PENCILS WITH ERASURE FERRULES HAVING A HOPPER WITH A COATING ON ITS SURFACE THAT PREVENTS THE FERRULES FROM CONTACTING THE HOPPER

This invention relates to apparatus for dispensing generally cylindrical objects. More particularly, it relates to vending machines for selling generally cylindrical objects such as pencils and the like.

Cylindrical objects have been sold by vending machines for many years. U.S. Pat. No. 439,030, which issued to Dieterich on Oct. 21, 1890, shows a vending machine for selling small vials of whiskey or other liquids. Other vending machines have been used to sell or dispense toothpicks, cigarettes, candy and other goods in cylindrical packages. U.S. Pat. No. 3,743,135, which issued to Brumley on July 3, 1973, and U.S. Pat. No. 4,706,842, which issued to Guadagnino on Nov. 17, 1987, show vending machines for selling pencils.

Apparatus for dispensing generally cylindrical objects usually include a hopper for storing the objects and a mechanism for delivering the objects to an outlet on demand. One problem such apparatus must overcome is bridging which occurs when the objects wedge together and hold one another against the forces of gravity. The Brumley patent, for example, discloses movable converging walls to rearrange the objects and break up any bridge which forms.

Another common problem occurs when the weight of the objects interferes with the proper operation of the dispenser. The weight of the objects pushes down on the objects near the bottom, which are usually the first objects to be dispensed. If the weight of the objects is excessive, the objects near the bottom may be wedged together and the apparatus may malfunction.

A third common problem is seen particularly in vending machines for selling pencils. Pencils usually have erasers on one end held in place by metal ferrules. The ferrules are usually about 0.010 to 0.012 inch larger in diameter than the rest of the pencil. In many cases ferrules do not roll or slide well. As a result, the pencils may become misaligned in the hopper and may cause a malfunction.

The apparatus of the invention solves these common problems The apparatus of the invention has a hopper for storing a quantity of generally cylindrical objects within a housing. A delivery reservoir is located below the hopper and holds a selected number of the objects. When an activation mechanism is moved, the objects fall from the hopper into the delivery reservoir and then out of the delivery reservoir into an outlet. A platform extends over a portion of the hopper to keep the weight of some of the objects off the objects near the bottom. The platform can be pivoted upward to provide easy access to the delivery reservoir. A patina on the surface of the hopper holds the objects to keep the ferrules off the surface of the hopper. The bodies of the pencils roll or slide on the patina and the ferrules of the pencils do not contact either the patina or the surface of the hopper.

The hopper includes at least one agitator which moves with respect to the rest of the hopper. As the agitator moves, it pushes the objects against an opposing surface to align the objects which are about to drop into the delivery reservoir.

Other features and advantages of the invention will become more readily understood from the following detailed description taken in connection with the appended claims and attached drawing in which:

Figure 1:
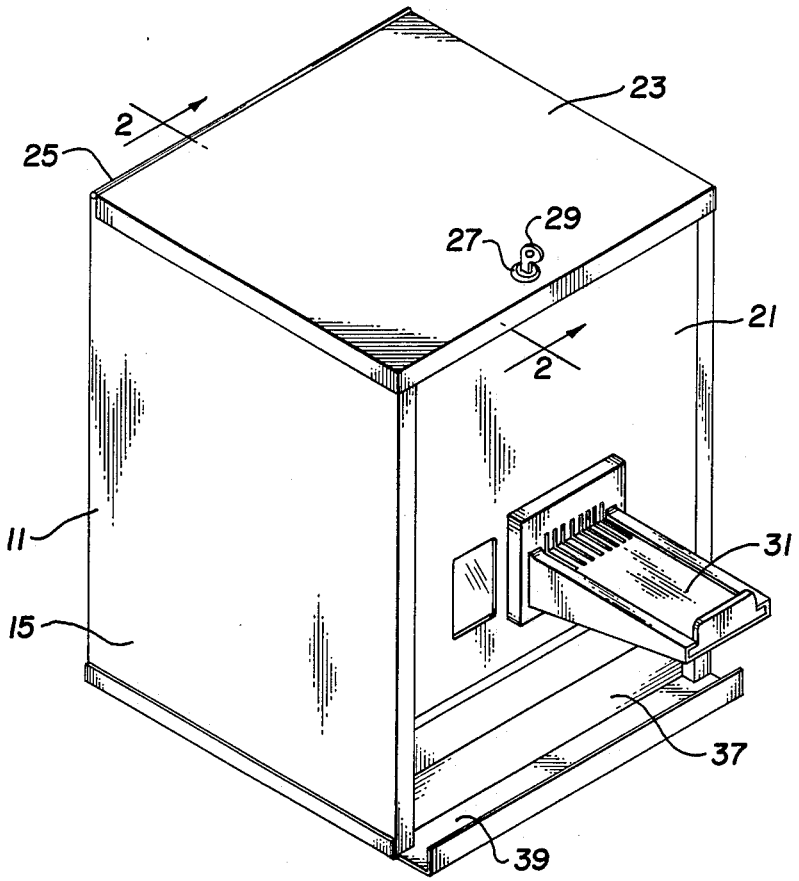
FIG. 1 is a perspective view of the preferred embodiment of the invention.

The preferred embodiment of the invention, as shown in the drawing, includes a housing 11. The housing 11 has a rear panel 13 and two side panels 15 and 17 which are permanently attached to a bottom 19. The housing also has a front panel 21 and a top 23. The top 23 is attached to the rear panel 13 with a hinge 25. When the top 23 is closed, the top 23 holds the front panel 21 in place. When the top 23 is open, the front panel 21 can be removed from housing 11. The top 23 can be secured with a lock 27 and key 29.

A standard coin mechanism 31 is located in the front panel 21 of the housing 11. The coin mechanism 31 can be adjusted to operate when a selected amount of money is inserted into the mechanism 31. When the selected amount of money has been inserted, the mechanism can be pushed in and pulled out. As the mechanism is pushed in, the coins in the mechanism fall into a money box 33. A selected number of generally cylindrical objects, such as pencils 35, fall out of the outlet 37 into a tray 39.

The money in the money box 33 can be periodically removed from the housing 11 by opening the top 23 and removing the front panel 21. The money box 33 can then be removed from the housing 11 and emptied.

The supply of pencils 35 is replenished by opening the top 23 of the housing 11 and placing a quantity of pencils 35 into a hopper 41 located in the housing 11. The hopper 41 includes a stationary wall 43 and a movable agitator 45.

Some of the pencils 35 are supported by a platform 47 which extends over a portion of the hopper 41. The platform 47 has a substantially flat first plate 49 which extends over the hopper 41. A substantially flat second plate 51 is attached to the first plate 49 along a shared edge to form an acute angle between the two plates 49 and 51.

The platform 47 is attached to the inside surface of the rear panel 13 with a hinged connector 53 located along the shared edge of the two plates 49 and 51. Thus, the first plate 49 extends over the hopper 41 at a downward slope so the pencils 35 will roll or slide off the platform 47 into the hopper 41. When desired, the platform 47 can be pivoted upward to allow pencils 35 to be placed into the hopper 41 below the platform 47.

The stationary wall 43 of the hopper 41 is located below the platform 47. The wall 43 has a vertical section 55 and an inclined section 57. The inclined section 57 is attached to the rear panel 13 of the housing 11. The slight incline of the inclined section 57 causes the pencils 35 to roll or slide down the wall 43 away from the rear panel 13.

The movable agitator 45 of the hopper 41 has a small vertical section 59, an inclined section 61, and a large vertical section 63. The small vertical section 59 of the agitator 45 is spaced a short distance away from the vertical section 55 of the stationary wall 43. A small number of pencils 35 can fit within the space between the wall 43 and the agitator 45.

The inclined section 61 of the agitator 45 is inclined to cause the pencils 35 to roll or slide down the agitator 45 toward the space between the agitator 45 and the wall 43. The inclined section 61 of the agitator 45 is only partially below the platform 47. Therefore, as pencils 35 roll or slide off the platform 47 the pencils 35 land on the inclined section 61 of the agitator 45.

Figure 4:
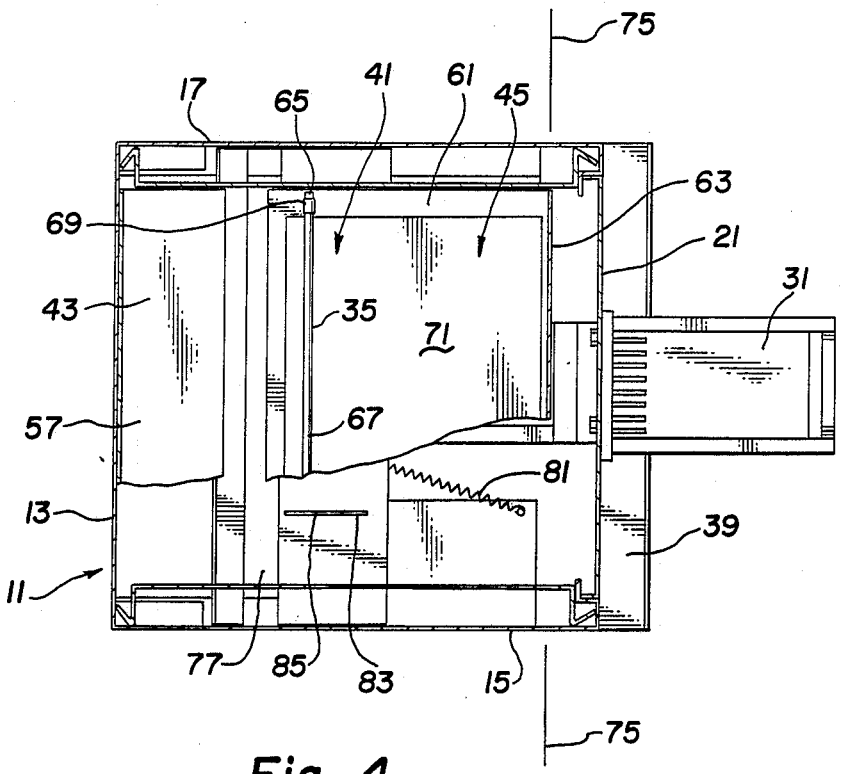
FIG. 4 is a cross-sectional view taken along lines 4—4 in FIG. 2 wherein some of the parts are broken away for clarity.

As shown in FIG. 4, pencils 35 commonly have erasers 65 attached to the wooden bodies 67 of the pencils 35 with metal ferrules 69. The ferrule 69 is usually about 0.010 to 0.012 inch larger in diameter than the wooden body 67 of the pencil 35. A thin metal patina 71 is located on the upper surface of the inclined section 61 of the agitator 45. The patina 71 holds the ferrules 69 of the pencils 35 off the surface of the agitator 45. The ferrules 69 generally have a higher coefficient of friction than the bodies 67 of the pencils 35, so the pencils 35 will roll or slide straighter and more easily if the ferrules 69 do not contact the agitator 45.

The upper end 73 of the large vertical section 63 of the agitator 45 is connected to the housing 11. The agitator 45 can pivot about a horizontal axis 75 through the upper end 73 of the large vertical section 63. As the agitator 45 pivots, the small vertical section 59 of the agitator 45 moves toward the vertical section 55 of the stationary wall 43.

A delivery reservoir 77 is located within the housing 11 directly below the hopper 41. The delivery reservoir 77 is capable of holding a selected number of cylindrical objects. In the preferred embodiment, the reservoir 77 can hold two pencils 35.

Figure 2:
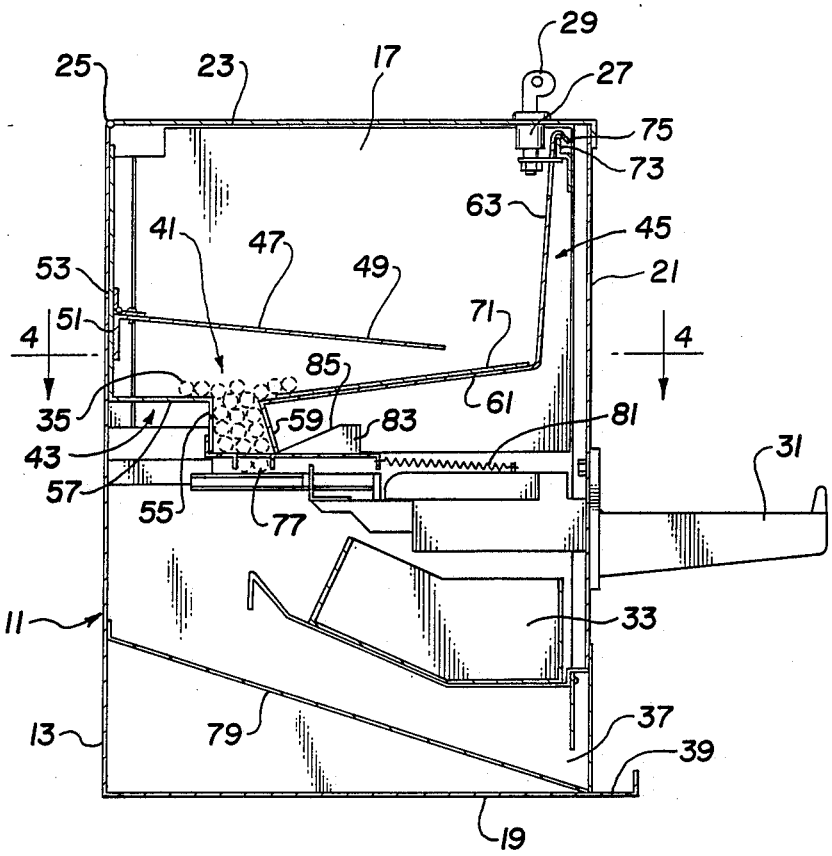
FIG. 2 is a cross-sectional view taken along lines 2—2 of FIG. 1 wherein the delivery reservoir is in a first positon.
Figure 3:
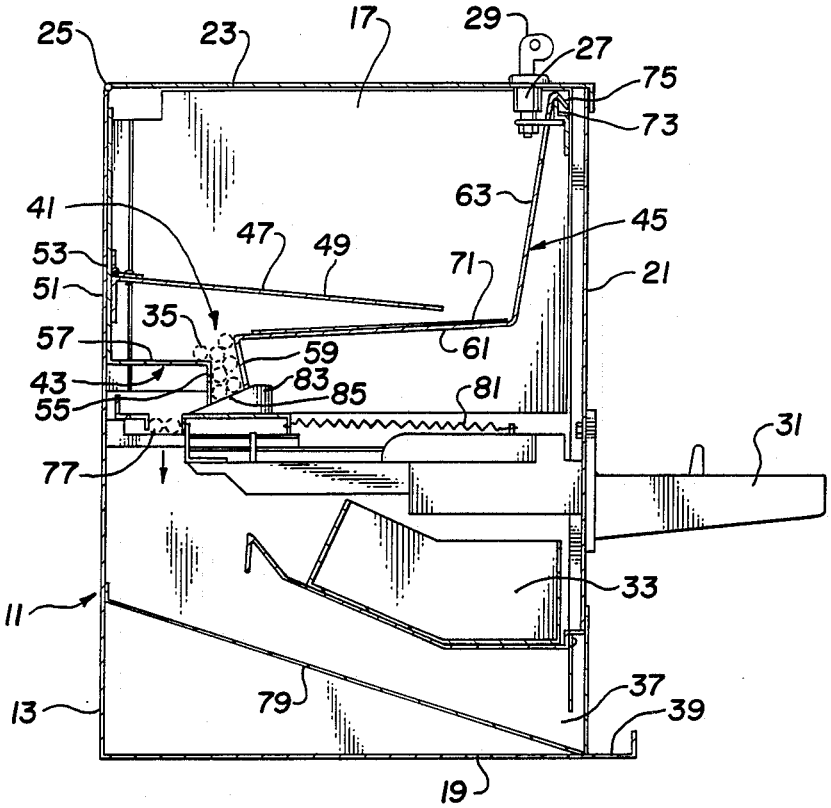
FIG. 3 is a cross-sectional view taken along lines 2—2 of FIG. 1 wherein the delivery reservoir is in a second position.

The delivery reservoir 77 is movable between two positions. In the first position, shown in FIG. 2, pencils 35 fall from the hopper 41 into the reservoir 77. In the second position, shown in FIG. 3, the pencils 35 in the reservoir 77 fall out of the reservoir 77 and roll or slide down a ramp 79 through the outlet 37 to the tray 39.

The delivery reservoir 77 is moved from the first position to the second position by the coin mechanism 31 as the coin mechanism 31 is pushed in. When the coin mechanism 31 is pulled out, a pair of springs 81 pull the delivery reservoir 77 back to the first position.

A pair of metal plates 83 extend upwardly from the delivery reservoir 77. The plates 83 have inclined edges 85 upon which the small vertical section 59 of the agitator 45 rests.

The apparatus of the invention is prepared for operation by opening the top 23 and placing a quantity of pencils 35 into the hopper 41. The platform 47 may be pivoted upward to allow easy access to the hopper 41. After a few pencils 35 have been placed in the hopper 41, the platform 47 is lowered and the remaining pencils 35 are placed on the platform 47.

The coin mechanism 31 is adjusted to operate upon the deposit of a selected amount of money. The top 23 is closed and secured by locking the lock 27 with the key 29. The apparatus is then operated by placing the selected amount of money in the coin mechanism 31 and the coin mechanism 31 is pushed in. The coin mechanism 31 pushes the delivery reservoir 77 from its first position to its second position.

As the delivery reservoir 77 moves from its first position to its second position, the inclined edges 85 of the plates 83 push upward on the agitator 45 and cause the agitator 45 to pivot about the axis 75 at the upper end 73 of the agitator 45.

As the agitator 45 pivots, the small vertical section 59 of the agitator 45 moves toward the vertical section 55 of the stationary wall 43. The pencils 35 are squeezed together to straighten the pencils in the space between the wall 43 and the agitator 45.

When the delivery reservoir 77 reaches its second position, the two pencils 35 in the reservoir 77 fall out of the reservoir 77. The pencils 35 roll or slide down the ramp 79 through the outlet 37 to the tray 39. The coin mechanism 31 is then pulled out. As the mechanism 31 is pulled out, the springs 81 pull the delivery reservoir 77 back to its original position. As the delivery reservoir 77 moves from its second position back to its first position, the agitator 45 falls back to its original position. The small vertical section 59 of the agitator 45 moves away from the vertical section 55 of the wall 43 and a new pair of pencils 35 fall into the delivery reservoir 77. The apparatus is then ready for a second operation.

The apparatus of the invention has several advantages over the prior art. The platform 47 holds many of the pencils 35 off the hopper 41 so the weight of those pencils 35 does not interfere with the proper operation of the apparatus. The patina 71 on the inclined section 61 of the agitator 45 holds the ferrules 69 of the pencils 35 off the agitator 45 so the pencils 35 roll or slide more easily. Also, the agitator 45 pivots and moves toward the stationary wall 43 As the pencils 35 are squeezed between the agitator 45 and the wall 43, the pencils 35 are aligned and thus cannot form bridges to keep the pencils 35 from falling into the reservoir 77. Accordingly, while the invention has been described with particular reference to a specific embodiment thereof, various changes and modifications may be resorted to without departing from the spirit and scope of the invention as defined by the appended claims.

What is claimed:

1. Apparatus for dispensing generally cylindrical and elongated pencils, each having an eraser ferrule attached at one end thereof, said apparatus comprising:

a housing having an outlet from which pencils may be dispensed;

a hopper within the housing for storing a quantity of pencils positioned substantially horizontally and parallel with each other;

a delivery reservoir located within the housing below the hopper capable of holding a selected number of pencils;

an activation mechanism for moving the delivery reservoir from a first position in which said selected number of pencils may fall from the hopper into the delivery reservoir and a second position in which the pencils in the delivery reservoir may fall from the delivery reservoir to said outlet;

an agitator positioned within said hopper and defining the floor thereof, said agitator including an upper surface inclined in a first direction and adapted to support pencils thereon so that such pencils may move down said inclined surface; and a patina on the upper surface of the agitator of sufficient thickness and width to support pencils positioned thereon so that the ferrules on the ends of the pencils do not contact the inclined surface of said agitator and do not contact the patina.

2. Apparatus as defined in claim 1 including a platform located inside the housing and extending over a portion of the hopper for supporting the weight of a portion of the pencils in the housing.

3. Apparatus as defined in claim 2 wherein the platform comprises:

a substantially flat first plate extending over the hopper;

a substantially flat second plate attached to the first plate along one edge to form an acute angle between the two plates; and a hinged connector for connecting the shared edges of the plates to the inside of the housing.

4. Apparatus as defined in claim 2 wherein a portion of the platform is substantially flat and extends over the hopper at a downward slope to cause the pencils to fall from the platform.

5. Apparatus as defined in claim 2 wherein the platform can be pivoted upwardly to allow access to the hopper.

* * * * *